US008896491B1

(12) United States Patent
Chung et al.

(10) Patent No.: US 8,896,491 B1
(45) Date of Patent: Nov. 25, 2014

(54) CROSS-TYPE TRANSMISSION MODULE

(71) Applicant: Wistron NeWeb Corp., Hsinchu (TW)

(72) Inventors: Bing-Chun Chung, Hsinchu (TW); Chia-Shang Cheng, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 0 days.

(21) Appl. No.: 14/206,213

(22) Filed: Mar. 12, 2014

(30) Foreign Application Priority Data

Aug. 15, 2013 (TW) ..... 102129243 A

(51) Int. Cl.
*H01Q 21/26* (2006.01)
*H01Q 1/42* (2006.01)

(52) U.S. Cl.
CPC ..... *H01Q 21/26* (2013.01)
USPC ..... 343/797; 343/872; 343/879

(58) Field of Classification Search
CPC ..... H01Q 1/246; H01Q 13/08; H01Q 19/136; H01Q 19/185; H01Q 19/195; H04B 7/0469
See application file for complete search history.

(56) References Cited

U.S. PATENT DOCUMENTS

| | | | | |
|---|---|---|---|---|
| 4,686,536 | A * | 8/1987 | Allcock | 343/700 MS |
| 6,181,298 | B1 * | 1/2001 | Strickland | 343/895 |
| 6,329,954 | B1 * | 12/2001 | Fuchs et al. | 343/725 |
| 7,940,227 | B2 * | 5/2011 | Chou | 343/797 |
| 2005/0007295 | A1 * | 1/2005 | Janoschka et al. | 343/890 |
| 2005/0078046 | A1 * | 4/2005 | Theobold et al. | 343/797 |
| 2009/0095700 | A1 * | 4/2009 | Carroll | 215/220 |
| 2010/0033396 | A1 * | 2/2010 | Tanabe et al. | 343/834 |

* cited by examiner

*Primary Examiner* — Trinh Dinh
(74) *Attorney, Agent, or Firm* — Muncy, Geissler, Olds & Lowe, P.C.

(57) ABSTRACT

A cross-type transmission module is provided, including a first circuit board, a second circuit board, a first positioning structure, a second positioning structure and a base. The first circuit board includes a first antenna. The second circuit board includes a second antenna. The second circuit board intersects the first circuit board. The first V-shaped groove and a second V-shaped groove are formed between the first circuit board and the second circuit board. The first V-shaped groove is opposite to the second V-shaped groove. The first positioning structure is disposed in the first V-shaped groove, and is connected to the first circuit board and the second circuit board. The second positioning structure is disposed in the second V-shaped groove, and is connected to the first circuit board and the second circuit board. The first positioning structure and the second positioning structure are secured to the base.

15 Claims, 4 Drawing Sheets

CROSS-TYPE TRANSMISSION MODULE

CROSS REFERENCE TO RELATED APPLICATIONS

This Application claims priority of Taiwan Patent Application No. 102129243, filed on Aug. 15, 2013, the entirety of which is incorporated by reference herein.

BACKGROUND OF THE INVENTION

1. Field of the Invention

The present invention relates to a cross-type transmission module, and in particular to an easily assembled cross-type transmission module.

2. Description of the Related Art

Long Term Evolution technology commonly utilizes directional dipole antennas to transmit signals. The directional dipole antennas are disposed on a cross-type transmission module. The cross-type transmission module comprises two intersected circuit boards and a reflective cover. The circuit boards are secured on the reflective cover. Conventionally, the circuit boards are secured onto the reflective cover by bottom welding. However, securing the circuit boards by welding increases time and cost, and the circuit boards can be easily separated from the reflective cover (low reliability).

BRIEF SUMMARY OF THE INVENTION

A cross-type transmission module is provided, including a first circuit board, a second circuit board, a first positioning structure, a second positioning structure and a base. The first circuit board includes a first antenna. The second circuit board includes a second antenna, wherein the second circuit board intersects the first circuit board and is connected thereto, a first V-shaped groove and a second V-shaped groove are formed between the first circuit board and the second circuit board, and the first V-shaped groove is opposite to the second V-shaped groove. The first positioning structure is disposed in the first V-shaped groove, wherein the first positioning structure is connected to the first circuit board and the second circuit board. The second positioning structure is disposed in the second V-shaped groove, wherein the second positioning structure is connected to the first circuit board and the second circuit board. The first positioning structure and the second positioning structure are secured to the base.

In one embodiment, the first stand portion is mated with the first V-shaped groove, and the second stand portion is mated with the second V-shaped groove. Therefore, the first stand portion and the second stand portion restrict the movements of the first circuit board and the second circuit board on an X-Y plane. Additionally, the first connection portion is connected to the first positioning portion, the second connection portion is connected to the third positioning portion, the third connection portion is connected to the second positioning portion, and the fourth connection portion is connected to the fourth positioning portion, and therefore the movements of the first circuit board and the second circuit board in the Z direction are restricted by the first positioning structure and the second positioning structure.

In one embodiment, the base is a reflective cover. The first positioning structure and the second positioning structure are secured on the base by screws. The movements of the first circuit board and the second circuit board in the directions X, Y and Z are restricted by the first positioning structure and the second positioning structure. Therefore, by securing the first positioning structure and the second positioning structure 40 to the base, the first circuit board and the second circuit board can be easily secured on the base (reflective cover). Compared to the conventional art, the embodiment of the invention reduces time and cost, and improves reliability.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
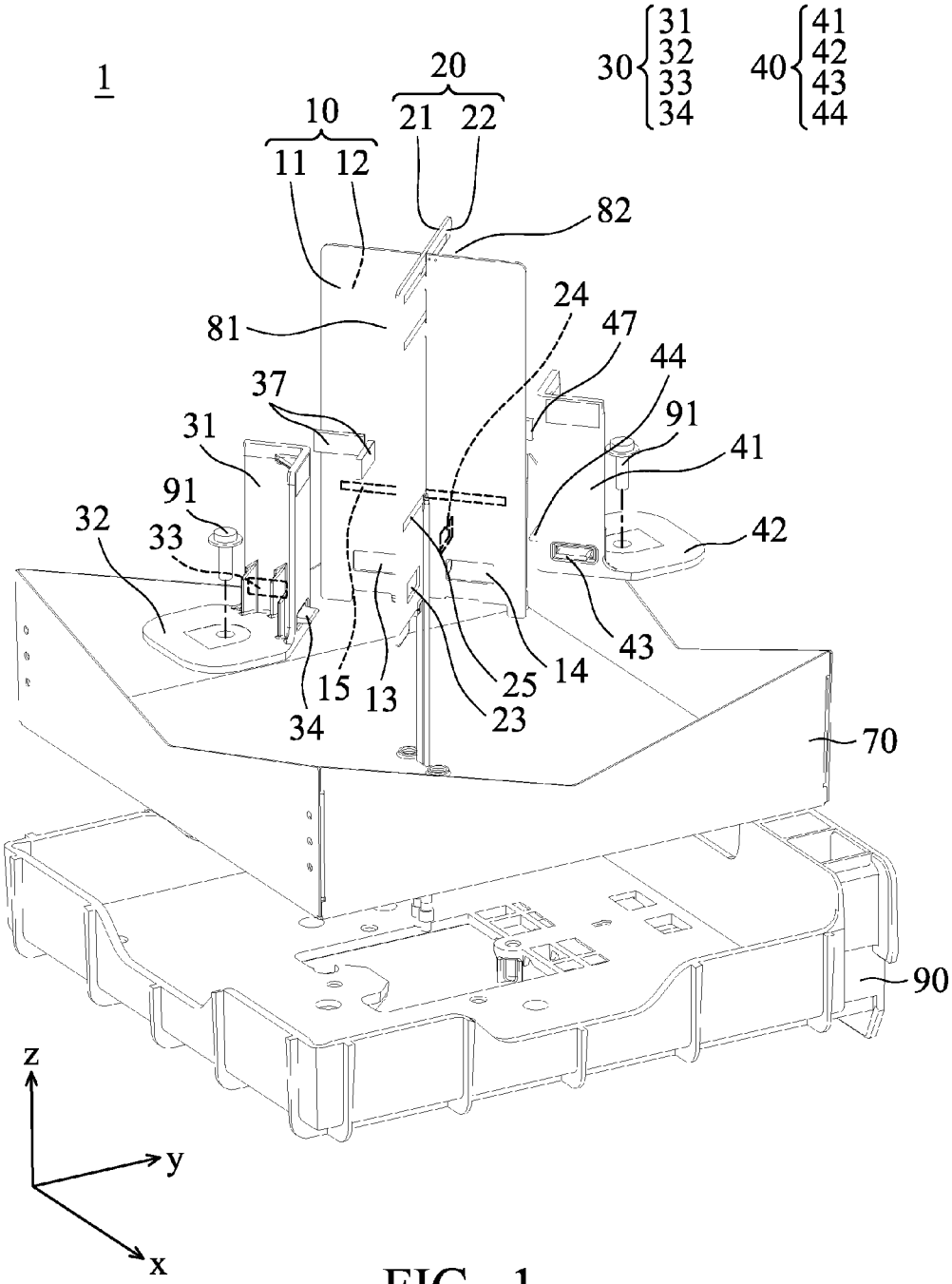
FIG. 1 shows the cross-type transmission module of an embodiment of the invention.

FIG. 1 shows a cross-type transmission module 1 of an embodiment of the invention, comprising a first circuit board 10, a second circuit board 20, a first positioning structure 30, a second positioning structure 40, a base 70 and an outer frame 90. The first circuit board 10 comprises a first antenna 15. The second circuit board 20 comprises a second antenna 25. The second circuit board 20 intersects the first circuit board 10 and is connected thereto. A first V-shaped groove 81 and a second V-shaped groove 82 are formed between the first circuit board 10 and the second circuit board 20, and the first V-shaped groove 81 is opposite to the second V-shaped groove 82. The first positioning structure 30 is disposed in the first V-shaped groove 81, wherein the first positioning structure 30 is connected to the first circuit board 10 and the second circuit board 20. The second positioning structure 40 is disposed in the second V-shaped groove 82, wherein the second positioning structure 40 is connected to the first circuit board 10 and the second circuit board 20. The first positioning structure 30 and the second positioning structure 40 are secured to the base 70. The base 70 is connected to the outer frame 90.

In one embodiment, the first circuit board 10 is perpendicular to the second circuit board 20.

The first circuit board 10 comprises a first surface 11 and a second surface 12, and the first surface 11 is opposite to the second surface 12. The second circuit board 20 comprises a third surface 21 and a fourth surface 22, and the third surface 21 is opposite to the fourth surface 22. The first V-shaped groove 81 is formed between at least a portion of the first surface 11 and at least a portion of the third surface 21 (one wall of the first V-shaped groove 81 comprises a portion of the first surface 11, and the other wall of the first V-shaped groove 81 comprises a portion of the third surface 21). The second V-shaped groove 82 is formed between at least a portion of the second surface 12 and at least a portion of the fourth surface 22 (one wall of the second V-shaped groove 82 comprises a portion of the second surface 12, and the other wall of the second V-shaped groove 82 comprises a portion of the fourth surface 22).

The first positioning structure 30 abuts the first surface 11 and the third surface 21, and the second positioning structure 40 abuts the second surface 12 and the fourth surface 22.

The first circuit board 10 comprises a first positioning portion 13 and a second positioning portion 14. The second circuit board 20 comprises a third positioning portion 23 and a fourth positioning portion 24. The first positioning structure 30 comprises a first connection portion 33 and a second connection portion 34. The second positioning structure 40 comprises a third connection portion 43 and a fourth connection portion 44. The first connection portion 33 is connected to the first positioning portion 13, the second connection portion 34 is connected to the third positioning portion 23, the third connection portion 43 is connected to the second positioning portion 14, and the fourth connection portion 44 is connected to the fourth positioning portion 24.

In one embodiment, the first positioning portion 13, the second positioning portion 14, the third positioning portion 23 and the fourth positioning portion 24 are through holes. The first connection portion 33, the second connection portion 34, the third connection portion 43 and the fourth connection portion 44 are protrusions.

The first positioning structure 30 comprises a first base portion 32 and a first stand portion 31, and the first stand portion 31 is connected to the first base portion 32. The second positioning structure 40 comprises a second base portion 42 and a second stand portion 41, and the second stand portion 41 is connected to the second base portion 42. The first connection portion 33 and the second connection portion 34 are formed on the first stand portion 31, and the third connection portion 43 and the fourth connection portion 44 are formed on the second stand portion 41. In one embodiment, the first stand portion 31 is perpendicular to the first base portion 32, and the second stand portion 41 is perpendicular to the second base portion 42.

In one embodiment, the first stand portion 31 is mated with the first V-shaped groove 81, and the second stand portion 41 is mated with the second V-shaped groove 82. Therefore, the first stand portion 31 and the second stand portion 41 restrict the movements of the first circuit board 10 and the second circuit board 20 on the X-Y plane. Additionally, the first connection portion 33 is connected to the first positioning portion 13, the second connection portion 34 is connected to the third positioning portion 23, the third connection portion 43 is connected to the second positioning portion 14, and the fourth connection portion 44 is connected to the fourth positioning portion 24, and therefore the movements of the first circuit board 10 and the second circuit board 20 in the Z direction are restricted by the first positioning structure 30 and the second positioning structure 40.

Figure 2A:
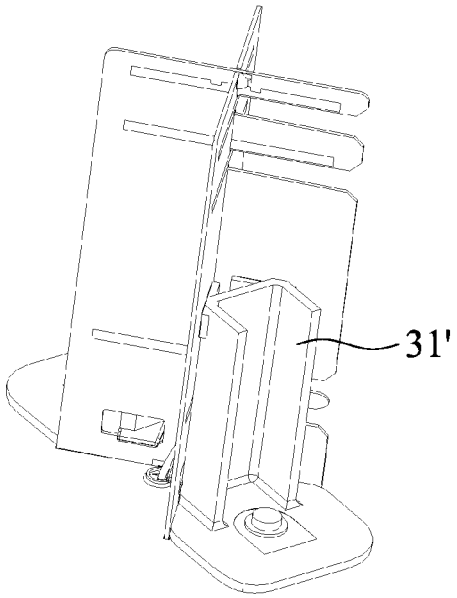
FIGS. 2A and 2B show modified examples of the first stand portion and the second stand portion, wherein the shapes of the first stand portion and the second stand portion are modified.
Figure 2B:
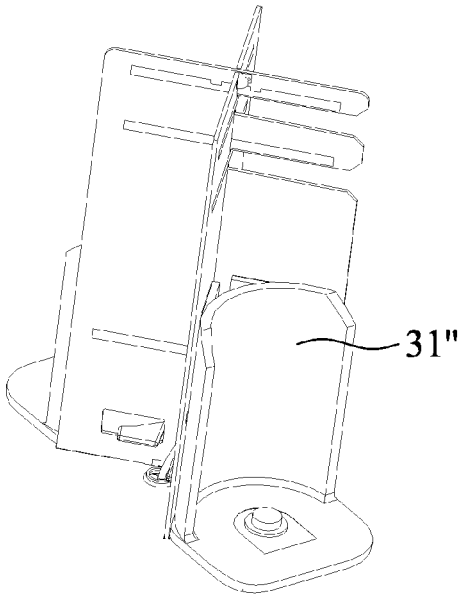

In one embodiment of the invention, the first stand portion 31 and the second stand portion 41 are V-shaped structures. However, the invention is not restricted by the disclosure. With reference to FIG. 2A, in a modified example, the first stand portion 31' and the second stand portion are U shaped structures. With reference to FIG. 2B, in another modified example, the first stand portion 31" and the second stand portion are arch structures (for example, half-circular walls).

The first positioning structure 30 comprises at least one first spacer 37, and the second positioning structure 40 comprises at least one second spacer 47. The first spacer 37 is disposed on the first stand portion 31 and contacting the first surface 11 and the third surface 21. The second spacer 47 is disposed on the second stand portion 41 and contacting the second surface 12 and the fourth surface 22.

In one embodiment, the base 70 is a reflective cover. The first positioning structure 30 and the second positioning structure 40 are secured on the base 70 by screws 91. The movements of the first circuit board 10 and the second circuit board 20 in the directions X, Y and Z are restricted by the first positioning structure 30 and the second positioning structure 40. Therefore, by securing the first positioning structure 30 and the second positioning structure 40 to the base 70, the first circuit board 10 and the second circuit board 20 can be easily secured on the base (reflective cover) 70. Compared to the conventional art, the embodiment of the invention reduces time and cost, and improves reliability.

Figure 3:
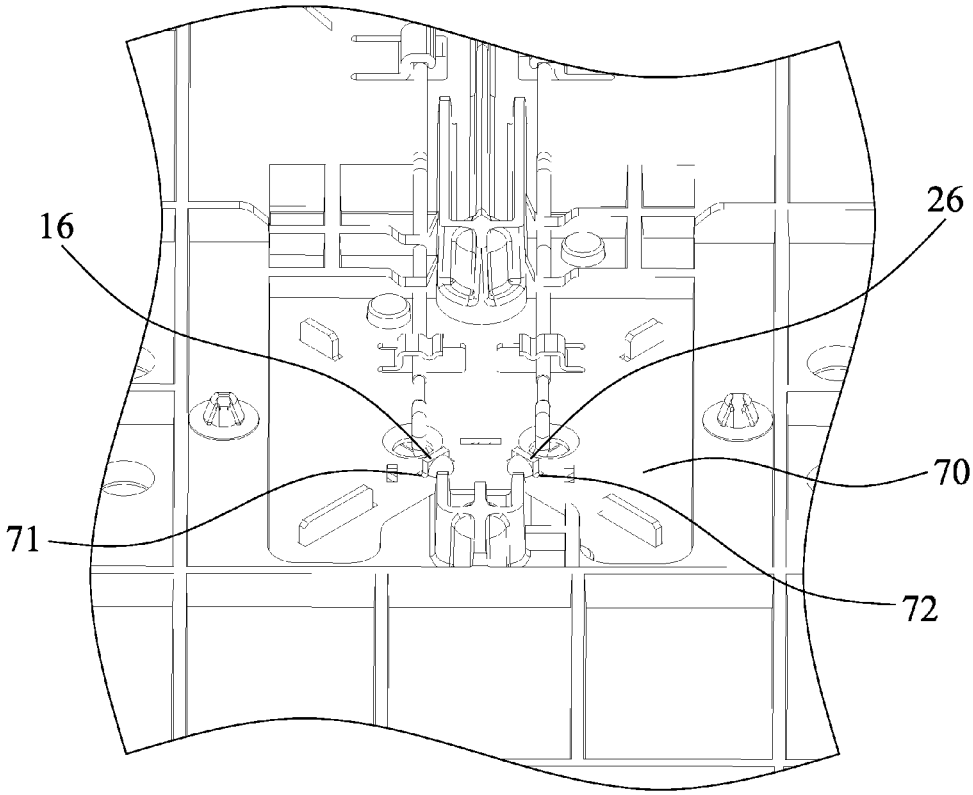
FIG. 3 shows how the first pin of the first circuit board and the second pin of the second circuit board are connected to the base.

With reference to FIG. 3, in this embodiment, the first circuit board 10 further comprises a first pin 16, and the second circuit board 20 further comprises a second pin 26. The base 70 comprises a first positioning hole 71 and a second positioning hole 72. The first pin 16 is inserted into the first positioning hole 71, the second pin 26 is inserted into the second positioning hole 72, and the first pin 16 and the second pin 26 are welded to the base 70 to be grounded.

Figure 4:
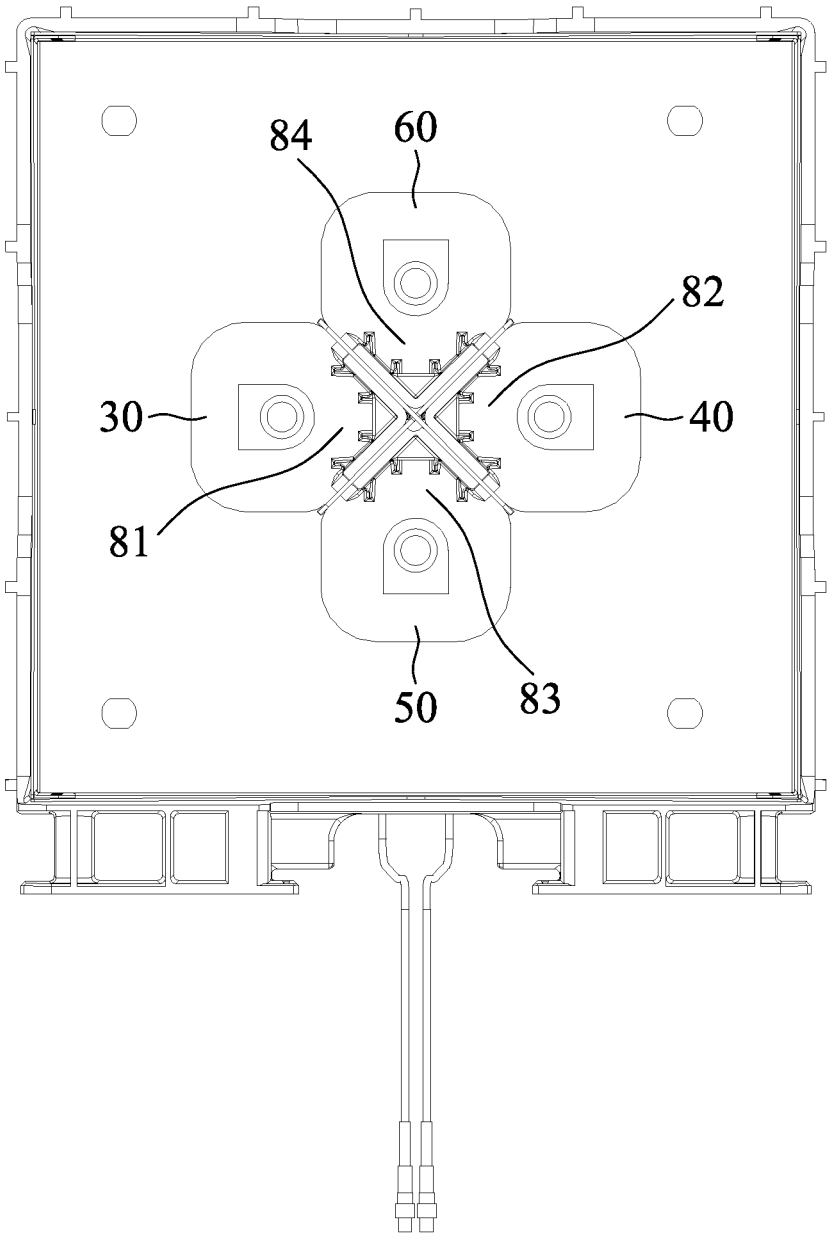
FIG. 4 shows the cross-type transmission module of another embodiment of the invention.

In the embodiments above, the circuit boards are secured by two positioning structures (the first positioning structure 30 and the second positioning structure 40). However, the invention is not restricted by the embodiments above. For example, with reference to FIG. 4, in one embodiment, the cross-type transmission module further comprises a third positioning structure 50 and a fourth positioning structure 60, wherein a third V-shaped groove 83 and a fourth V-shaped groove 84 are formed between the first circuit board 10 and the second circuit board 20. The third V-shaped groove 83 is opposite to the fourth V-shaped groove 84. The third V-shaped groove 83 is neighboring the first V-shaped groove 81. The third positioning structure 50 is disposed in the third V-shaped groove 83 and is connected to the first circuit board 10 and the second circuit board 20. The fourth positioning structure 60 is disposed in the fourth V-shaped groove 84 and is connected to the first circuit board 10 and the second circuit board 20, wherein the third positioning structure 50 and the fourth positioning structure 60 are secured to the base 70.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A cross-type transmission module, comprising:

a first circuit board, comprising a first antenna;

a second circuit board, comprising a second antenna, wherein the second circuit board intersects the first circuit board and is connected thereto, a first V-shaped groove and a second V-shaped groove are formed between the first circuit board and the second circuit board, and the first V-shaped groove is opposite to the second V-shaped groove;

a first positioning structure, disposed in the first V-shaped groove, wherein the first positioning structure is connected to the first circuit board and the second circuit board;

a second positioning structure, disposed in the second V-shaped groove, wherein the second positioning structure is connected to the first circuit board and the second circuit board; and a base, wherein the first positioning structure and the second positioning structure are secured to the base.

2. The cross-type transmission module as claimed in claim 1, wherein the first circuit board comprises a first surface and a second surface, the first surface is opposite to the second surface, the second circuit board comprises a third surface and a fourth surface, the third surface is opposite to the fourth surface, the first V-shaped groove is formed between at least a portion of the first surface and at least a portion of the third surface, and the second V-shaped groove is formed between at least a portion of the second surface and at least a portion of the fourth surface.

3. The cross-type transmission module as claimed in claim 2, wherein the first positioning structure abuts the first surface and the third surface, and the second positioning structure abuts the second surface and the fourth surface.

4. The cross-type transmission module as claimed in claim 3, wherein the first circuit board comprises a first positioning portion and a second positioning portion, the second circuit board comprises a third positioning portion and a fourth positioning portion, the first positioning structure comprises a first connection portion and a second connection portion, the second positioning structure comprises a third connection portion and a fourth connection portion, the first connection portion is connected to the first positioning portion, the second connection portion is connected to the third positioning portion, the third connection portion is connected to the second positioning portion, and the fourth connection portion is connected to the fourth positioning portion.

5. The cross-type transmission module as claimed in claim 4, wherein the first positioning portion, the second positioning portion, the third positioning portion and the fourth positioning portion are through holes, and the first connection portion, the second connection portion, the third connection portion and the fourth connection portion are protrusions.

6. The cross-type transmission module as claimed in claim 4, wherein the first positioning structure comprises a first base portion and a first stand portion, the first stand portion is connected to the first base portion, the second positioning structure comprises a second base portion and a second stand portion, the second stand portion is connected to the second base portion, the first connection portion and the second connection portion are formed on the first stand portion, and the third connection portion and the fourth connection portion are formed on the second stand portion.

7. The cross-type transmission module as claimed in claim 6, wherein the first stand portion is mated with the first V-shaped groove, and the second stand portion is mated with the second V-shaped groove.

8. The cross-type transmission module as claimed in claim 7, wherein the first stand portion and the second stand portion are V-shaped structures.

9. The cross-type transmission module as claimed in claim 6, wherein the first stand portion and the second stand portion are U shaped structures.

10. The cross-type transmission module as claimed in claim 6, wherein the first stand portion and the second stand portion are arch structures.

11. The cross-type transmission module as claimed in claim 6, wherein the first positioning structure comprises at least one first spacer, the second positioning structure comprises at least one second spacer, the first spacer is disposed on the first stand portion and contacting the first surface and the third surface, and the second spacer is disposed on the second stand portion and contacting the second surface and the fourth surface.

12. The cross-type transmission module as claimed in claim 1, wherein the first positioning structure and the second positioning structure are secured on the base by screws.

13. The cross-type transmission module as claimed in claim 1, wherein the base is a reflective cover.

14. The cross-type transmission module as claimed in claim 1, wherein the first circuit board further comprises a first pin, the second circuit board further comprises a second pin, the base comprises a first positioning hole and a second positioning hole, the first pin is inserted into the first positioning hole, the second pin is inserted into the second positioning hole, and the first pin and the second pin are welded to the base.

15. The cross-type transmission module as claimed in claim 1, further comprising a third positioning structure and a fourth positioning structure, wherein a third V-shaped groove and a fourth V-shaped groove are formed between the first circuit board and the second circuit board, the third V-shaped groove is opposite to the fourth V-shaped groove, the third V-shaped groove is neighboring the first V-shaped groove, the third positioning structure is disposed in the third V-shaped groove and is connected to the first circuit board and the second circuit board, and the fourth positioning structure is disposed in the fourth V-shaped groove and is connected to the first circuit board and the second circuit board, wherein the third positioning structure and the fourth positioning structure are secured to the base.

* * * * *